US007032516B2

(12) United States Patent
Mori

(10) Patent No.: US 7,032,516 B2
(45) Date of Patent: Apr. 25, 2006

(54) PRINTING PROCESS EMPLOYING DEVELOPMENT-ON-PRESS TYPE PRINTING PLATE MATERIAL

(75) Inventor: Takahiro Mori, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 10/825,773

(22) Filed: Apr. 16, 2004

(65) Prior Publication Data

US 2004/0211331 A1 Oct. 28, 2004

(30) Foreign Application Priority Data

Apr. 25, 2003 (JP) ..... 2003-121487

(51) Int. Cl.
*B41F /00* (2006.01)

(52) U.S. Cl. ..... 101/483; 101/424.1

(58) Field of Classification Search ..... 101/483, 101/484, 423–425

See application file for complete search history.

(56) References Cited

U.S. PATENT DOCUMENTS 3,735,702 A * 5/1973 Kossak ..... 101/425
3,897,726 A * 8/1975 Junghans ..... 101/425
4,757,763 A * 7/1988 MacPhee et al. ..... 101/425
4,841,862 A * 6/1989 Seefried ..... 101/425
5,148,746 A * 9/1992 Fuller et al. ..... 101/142
5,447,102 A * 9/1995 Pfeiffer et al. ..... 101/492
5,651,316 A * 7/1997 DeMoore et al. ..... 101/450.1
6,637,335 B1 * 10/2003 Jentzsch ..... 101/463.1
6,810,807 B1 * 11/2004 Hebert ..... 101/424

FOREIGN PATENT DOCUMENTS

EP 1 232 858 A1 8/2002
WO WO 97/12759 A1 4/1997

OTHER PUBLICATIONS

Patent Abstracts of Japan, vol. 2002, No. 06, Jun. 4, 2002 of JP 2002 059089 A (Komori Corp) Feb. 26, 2002.

* cited by examiner

*Primary Examiner*—Anthony H. Nguyen
(74) *Attorney, Agent, or Firm*—Frishauf, Holtz, Goodman & Chick, P.C.

(57) ABSTRACT

Disclosed are a printing process employing a printing press comprising a plate cylinder and a blanket cylinder, and employing a first printing plate material and a second printing plate material each material comprising a hydrophilic support and provided thereon, an image formation layer, the image formation layer at non-image portions being capable of being removed with dampening water or printing ink, the process comprising the steps of (a) mounting the first printing plate material on the plate cylinder; (b) carrying out printing by supplying dampening water and printing ink to the first printing plate material, (c) then washing the surface of the blanket cylinder with a cleaning solution; d) drying the washed surface of the blanket cylinder; (e) dismounting the first printing plate material from the plate cylinder; (f) mounting the second printing plate material on the plate cylinder, and (g) carrying out printing after the step (d).

8 Claims, No Drawings

PRINTING PROCESS EMPLOYING DEVELOPMENT-ON-PRESS TYPE PRINTING PLATE MATERIAL

FIELD OF THE INVENTION

The present invention relates to a printing process employing a printing plate material, and particularly to a printing process employing a printing plate material capable of forming an image by a computer to plate (CTP) system.

BACKGROUND OF THE INVENTION

The printing plate material for CTP, which is inexpensive, can be easily handled, and has a printing ability comparable with that of a PS plate, is required accompanied with the digitization of printing data. Recently, a thermal processless printing plate material which can be applied to a printing press employing a direct imaging (DI) process without development by a special developing agent or a versatile thermal processless printing plate material which can be treated in the same manner as in PS plates has been required.

The thermal processless type printing plate material is divided into an ablation type printing plate material, and a development-on-press type heat fusible image formation layer-containing printing plate material from the viewpoint of the image formation mechanism. The ablation type printing plate material has problems that it is low in sensitivity due to its image recording mechanism, and it is necessary to provide, in an exposure device, a sucking device for preventing a part of the image formation layer from scattering during laser exposure of the printing plate material.

The development-on-press type heat fusible image formation layer-containing printing plate material is more advantageous than the ablation type printing plate material, in that it is high in sensitivity, and it does not scatter a part of the image formation layer during laser exposure of the printing plate material.

However, it is necessary that a development-on-press type printing plate material such as the heat-fusible image formation layer-containing printing plate material above have, as an outermost layer or a layer under a water soluble layer protective layer, an image formation layer containing a water soluble component or a water swellable component, the image formation layer being such that when the layer is brought into contact with a dampening roller, an inking roller, or a blanket cylinder, the layer is likely to be removed at non-image portions. However, an aqueous solution or an organic solvent is likely to penetrate such a layer, and the above plate has problem in that the component contained in the layer is influenced by adherence of water or an organic solvent to the layer, resulting in image formation failure or development-on-press failure.

Herein, "a development-on-press type printing plate material" means a printing plate material comprising a layer capable of being removed with dampening water or printing ink on a printing press.

Examples of the heat-fusible image formation layer development-on-press type printing plate include a printing plate material comprising a hydrophilic layer or a surface-roughened aluminum plate and provided thereon, an image formation layer containing thermoplastic particles and a water-soluble binder (See for example, Japanese Patent O.P.I. Publication Nos. 9-123387 and 9-123387). However, even the plate having the structure also has problem in that adherence of water or an organic solvent to the image formation layer results in image formation failure or development-on-press failure.

A printing plate (or a printing plate material) is mounted on a plate cylinder of a press as follows. Being gripped at the leading edge of the printing plate with the plate leading edge gripper of the plate cylinder, the printing plate is nipped between the plate cylinder and a blanket cylinder, is rotated in such a direction that the plate is wound around the plate cylinder while pressing the plate to the plate cylinder by means of the blanket cylinder, whereby the plate is wound around the plate cylinder, and then is gripped at the trailing edge of the plate with the plate trailing edge gripper of the plate cylinder. Thus, the printing plate is wound around the plate cylinder and fixed on the plate cylinder. This method also applies in a DI press in which laser exposure is carried out.

However, when the development-on-press type printing plate material is employed, this method has problem in that water or an oleophilic substance-containing solvent, each remaining on a blanket cylinder, is transferred to the plate cylinder to the printing material, resulting in image formation failure or development-on-press failure.

The surface of the blanket cylinder is washed with a solvent or an aqueous solution every one round of printing. Accordingly, in order to obtain prints with stable quality employing the development-on-press type printing plate material, it is important to keep the blanket cylinder surface clean.

Hitherto, when the development-on-press type printing plate material is employed, any condition of the blanket cylinder surface has not been taken into consideration.

SUMMARY OF THE INVENTION

An object of the invention is to provide a printing process, employing a development-on-press type printing plate material, the printing process giving a stable and good developability on a press, and causing no image formation fault on imagewise exposure on a press.

[Means for Solving the Above Problems]

The above object of the invention can be attained by the following constitutions:

1. A printing process employing a printing press comprising a plate cylinder, a blanket cylinder, a dampening roller and an inking roller, and employing a first printing plate material and a second printing plate material each material comprising a hydrophilic support and provided thereon, an image formation layer, the image formation layer at non-image portions being capable of being removed with dampening water or printing ink, the process comprising the steps of (a) mounting the first printing plate material on the plate cylinder; (b) carrying out printing by supplying dampening water and printing ink to the first printing plate material with the dampening roller and the inking roller, whereby the printing ink was transferred from the printing material onto a printing paper sheet through the blanket cylinder, the blanket cylinder contacting the first printing plate material; (c) then washing the surface of the blanket cylinder with a cleaning solution; (d) drying the washed surface of the blanket cylinder; (e) dismounting the first printing plate material from the plate cylinder; (f) mounting the second printing plate material on the plate cylinder; and (g) carrying out printing by supplying dampening water and printing ink to the second printing plate material with the dampening roller and the inking roller, after the step (d).

2. The printing process of item 1 above, wherein the step (e) is carried out between the steps (b) and (c), or during or after the step (c).

3. The printing process of item 1 above, wherein the step (e) is carried out during or after the step (d).

4. The printing process of item 1 above, wherein the drying is carried out by wiping off the residual cleaning solution on the blanket cylinder surface with dry cloth.

5. The printing process of item 1 above, wherein the drying is carried out by spraying warm air or cold air onto the blanket cylinder surface to eliminate the residual cleaning solution on the blanket cylinder surface.

6. The printing process of item 1 above, wherein the drying is carried out by carrying out printing without supplying dampening water or printing ink, whereby the residual cleaning solution on the blanket cylinder surface is transferred onto a printing paper sheet.

7. The printing process of item 1 above, wherein the process further comprises the step of forming an image on the printing plate material between the steps (a) and (b).

8. The printing process of item 7 above, wherein the image formation is carried out by imagewise exposing the printing plate material to infrared laser.

1-1. A printing process employing a printing plate material comprising a layer, at least a part of the layer being capable of being removed with dampening water or printing ink on a printing press, the process comprising the steps of (a) mounting a first printing plate material on a plate cylinder of the printing press, (b) carrying out printing (including developing the first printing plate material on the plate cylinder to prepare a printing plate), (c) washing a surface of a blanket cylinder with a cleaning solution, (d) then drying the washed surface of the blanket cylinder, (e) dismounting the first printing plate material from the plate cylinder, and (f) then mounting a second printing plate material on the plate cylinder which the first printing plate material has been dismounted, wherein the step (e) is carried out before or after the step (b), before or after the step (c), during the step (c), or during the step (d).

1-2. The printing process of item 1-1 above, wherein the drying step is carried out by wiping off the cleaning solution remaining on the blanket cylinder surface through dry cloth.

1-3. The printing process of item 1-1 above, wherein the drying step is carried out by spraying warm air or cold air to the blanket cylinder surface.

1-4. The printing process of item 1-1 above, wherein the drying step is carried out by printing, whereby the cleaning solution remaining on the blanket cylinder surface is adhered or transferred to printing sheet fed onto the blanket cylinder.

1-5. The printing process of any one of items 1-1 through 1-4 above, between the steps (a) and (b), further comprising the step of forming an image on the printing plate material.

1-6. The printing process of item 1-5 above, wherein the image forming step is carried out employing infrared laser.

The present invention will be detailed below.

The present invention is a printing process employing a printing press comprising a plate cylinder, a blanket cylinder, a dampening roller and an inking roller, and employing a first printing plate material and a second printing plate material each material comprising a hydrophilic support and provided thereon, an image formation layer, the image formation layer at non-image portions being capable of being removed with dampening water or printing ink, the process comprising the steps of (a) mounting the first printing plate material on the plate cylinder; (b) carrying out printing by supplying dampening water and printing ink to the first printing plate material with the dampening roller and the inking roller, whereby the printing ink was transferred from the printing material onto a printing paper sheet through the blanket cylinder, the blanket cylinder contacting the first printing plate material; (c) then washing the surface of the blanket cylinder with a cleaning solution; d) drying the washed surface of the blanket cylinder; (e) dismounting the first printing plate material from the plate cylinder; (f) mounting the second printing plate material on the plate cylinder; and (g) carrying out printing by supplying dampening water and printing ink to the second printing plate material with the dampening roller and the inking roller, after the step (d).

It is preferred that the step (e) above is carried out between the steps (b) and (c), or during or after the step (c). It is also preferred that the step (e) above is carried out during or after the step (d).

As described above, the drying of the blanket cylinder surface after having been washed with a cleaning solution makes it possible to satisfactorily carry out development-on-press, which follows the drying step. Herein, "development-on-press" means a step supplying a dampening water and printing ink to an image formation layer of the printing plate material mounted on a press to remove the image formation layer at non-exposed portions to obtain a printing plate for printing.

As methods for washing the blanket cylinder, there are well known various methods. Examples thereof include the following:

(1) a method in which the blanket cylinder surface is sprayed with a cleaning solution, and is brought into contact with a rotating brush to remove stains (2) a method in which a non-woven fabric sprayed with a cleaning solution is pressed on the blanket cylinder surface to wipe off stains (3) a method in which non-woven fabric impregnated with a cleaning solution with low volatility is pressed against the blanket cylinder surface to wipe off stains When a cleaning solution with low volatility is employed as in method 3 above, it remains on the blanket cylinder surface. Accordingly, unless drying of the washed blanket is carried out, there may occur problem that development-on-press, followed by the next printing, is not successfully carried out.

In the invention, as one embodiment of drying methods of the blanket cylinder, there is a method which wipes off the cleaning solution remaining on the blanket cylinder surface with dry fabric.

For example, in a printing press equipped with a blanket washing device comprising an unwinding member of non-woven fabric in roll form, an up-take member of non-woven fabric and provided between them, a pressing member for pressing the non-woven fabric to the blanket cylinder surface, a dry non-woven fabric (new fabric) in roll form is unwound, impregnated with a cleaning solution, transported to the pressing member, and then the cleaning solution-impregnated non-woven fabric is pressed against the blanket cylinder surface by the pressing member, whereby the blanket cylinder surface is washed. After that, a second dry non-woven fabric (new fabric) in roll form is unwound, transported to the pressing member without being impregnated with the cleaning solution, and pressed against the blanket cylinder surface by the pressing member, whereby the blanket cylinder surface is dried.

In the above, when a blanket washing device (A) is used which employs non-woven fabric in advance impregnated with a cleaning solution with low volatility, a blanket washing device (B), employing a dry non-woven fabric, is used together with the blanket washing device (A), where the blanket washing device (A) washes the blanket surface, and the blanket washing device (B) dries the blanket surface.

As another embodiment of drying methods of the blanket cylinder, there is a method which blows hot air or cold air onto a blanket cylinder surface to dry the blanket cylinder surface. In this method, a blowing member for blowing hot air or cold air is provided so that the hot air or the cold air is blown onto the blanket cylinder surface. After the washing, the hot air or the cold air is blown onto the blanket cylinder surface at a temperature sufficient to dry the blanket cylinder surface or in an amount sufficient to dry the blanket cylinder surface.

After washing the blanket cylinder surface, drying of the blanket cylinder surface can be carried out by rotating the blanket cylinder to form an air (cold) flow, however, this method increases time for setting the next printing, and is therefore not efficient.

As still another embodiment of drying methods of the blanket cylinder, there is a method which applies to printing paper sheets or makes printing paper sheets absorb, the cleaning solution remaining on the blanket cylinder surface after printing is carried out.

In this embodiment, the step of printing is needed, and it is preferred that the printing plate remains mounted on the plate cylinder of a press during the drying step for drying a blanket cylinder surface, i.e., carrying out printing. Therefore, it is preferred that the printing plate surface has been washed together with the blanket cylinder surface before drying. The washing of the printing plate can be carried out, bringing the plate cylinder into contact with the blanket cylinder while washing the blanket cylinder.

In the above embodiment, drying of the blanket cylinder is carried out by printing without supplying dampening water or printing ink to the printing plate. The printing paper sheet used is preferably one having such a size that it can contact the entire surface of the blanket cylinder and absorb the residual cleaning solution on the blanket cylinder, and is more preferably one having the largest size used in the printing press. Since the plate cylinder is brought into contact with the blanket cylinder on printing, the cleaning solution remaining on the printing plate is also absorbed by the printing paper through the blanket cylinder.

In this embodiment, the number of paper sheets used for drying the blanket cylinder is 1 to 50, and preferably 1 to 10. As the typical drying method, a method disclosed in Japanese Patent O.P.I. Publication No. 2002-59089 can be used.

The printing process of the invention can comprise the step of carrying out image formation between the steps (a) and (b) above.

As a method for the image formation, a method can be used in which an image is formed on the development-on-press type printing plate material according to an ink jet process disclosed in Japanese Patent O.P.I. Publication No. 2001-232746, but in the invention, a method is preferred in which an image is formed on a development-on-press type printing plate material according to an image formation method employing an infrared laser.

With respect to exposure, scanning exposure is preferred which is carried out employing an infrared or near-infrared laser which emits light having a wavelength of from 700 to 1500 nm. As the laser, a gas laser can be used, but a semiconductor laser, which emits near-infrared light, is preferably used.

The scanning exposure device used in the invention may be any as long as it can form an image on the surface of a printing plate material employing the semiconductor laser, based on image formation from a computer.

Preferred examples of the development-on-press type printing plate material used in the invention include a printing plate material comprising a hydrophilic support as described later and provided thereon, an image formation layer containing hydrophobic precursor particles, or a printing plate material comprising a substrate and provided thereon, an hydrophilic layer described later, an image formation layer containing hydrophobic precursor particles in that order.

As a substrate for the hydrophilic support in the invention, those well known in the art as substrates for printing plates can be used. Examples of the substrate include a metal plate, a plastic film sheet, a paper sheet treated with polyolefin, and composite materials such as laminates thereof. The thickness of the substrate is not specifically limited as long as a printing plate having the substrate can be mounted on a printing press, and is advantageously from 50 to 500 μm in easily handling.

Examples of the metal plate include iron, stainless steel, and aluminum. Aluminum is especially preferable in its gravity and stiffness. Aluminum is ordinarily used after degreased with an alkali, an acid or a solvent to remove oil on the surface, which has been used when rolled and wound around a spool. The degreasing is carried out preferably employing an aqueous alkali solution. In order to increase adhesion between the substrate and a coating layer, it is preferred that the surface of the substrate is subjected to adhesion increasing treatment or is coated with a subbing layer. For example, the substrate is immersed in a solution containing silicate or a coupling agent such as a silane coupling agent, or the substrate is coated with the solution and then sufficiently dried. Anodization treatment is considered to be one kind of adhesion increasing treatment, and can be used. The anodization treatment and the immersing or coating treatment described above can be used in combination. Aluminum plate (so-called grained aluminum plate), which has been surface-roughened with a conventional method, can be used as a substrate having a hydrophilic surface (a hydrophilic support).

Examples of the plastic film include a polyethylene terephthalate film, a polyethylene naphthalate film, a polyimide film, a polyamide film, a polycarbonate film, a polysulfone film, a polyphenylene oxide film, and a cellulose ester film. The plastic film is preferably a polyethylene terephthalate film, or a polyethylene naphthalate film. In order to increase adhesion between the support and a coating layer, it is preferred that the surface of the plastic film is subjected to adhesion increasing treatment or is coated with a subbing layer. Examples of the adhesion increasing treatment include corona discharge treatment, flame treatment, plasma treatment and UV light irradiation treatment. Examples of the subbing layer include a layer containing gelatin or latex. The subbing layer can contain an electrically conductive material such as AT sol. A substrate with a known backcoat layer coated can be used.

The composite support can be obtained suitably laminating the above supports. Laminating may be carried out before or after forming a coating layer. Further, laminating may be carried out immediately before mounting it on a printing press.

As the substrate for a hydrophilic support used in the printing plate material in the invention, an aluminum plate as described below is preferred.

The aluminum plate is an aluminum plate or an aluminum alloy plate. As the aluminum alloy, there can be used various ones including an alloy of aluminum and a metal such as silicon, copper, manganese, magnesium, chromium, zinc, lead, bismuth, nickel, titanium, sodium or iron.

The aluminum plate is surface-roughened as follows to obtain the hydrophilic support in the invention. It is preferable that the aluminum plate is subjected to degreasing treatment for removing rolling oil prior to surface roughening. The degreasing treatments include degreasing treatment employing solvents such as trichlene and thinner, and an emulsion degreasing treatment employing an emulsion such as kerosene or triethanol. It is also possible to use an aqueous alkali solution such as an aqueous solution of sodium hydroxide, potassium hydroxide, sodium carbonate, or sodium phosphate for the degreasing treatment. When such an aqueous alkali solution is used for the degreasing treatment, it is possible to remove soils and an oxidized film which can not be removed by the above-mentioned degreasing treatment alone.

When the aqueous alkali solution is used for the degreasing treatment, the resulting plate is preferably subjected to neutralization treatment in an aqueous solution of an acid such as phosphoric acid, nitric acid, sulfuric acid, chromic acid, or in an aqueous solution of a mixture thereof. The electrolytic surface roughening after the neutralization is carried out preferably in the same acid solution as in the neutralization treatment.

The electrolytic surface roughening treatment of the aluminum plate is carried out according to a known method, but prior to that, chemical surface roughening treatment and/or mechanical surface roughening treatment may be carried out. The mechanical surface roughening treatment is preferably carried out.

The chemical surface roughening treatment is carried out employing an aqueous alkali solution such as an aqueous solution of sodium hydroxide, potassium hydroxide, sodium carbonate, or sodium phosphate in the same manner as in degreasing treatment above. After that, the resulting plate is preferably subjected to neutralization treatment in an aqueous solution of an acid such as phosphoric acid, nitric acid, sulfuric acid, chromic acid, or in an aqueous solution of a mixture thereof. The electrolytic surface roughening after the neutralization is carried out preferably in the same acid solution as in the neutralization treatment.

Though there is no restriction for the mechanical surface roughening method, a brushing roughening method and a honing roughening method are preferable.

The brushing roughening method is carried out by rubbing the surface of the plate with a cylindrical brush with a brush hair with a diameter of 0.2 to 1 mm, while supplying slurry, in which an abrasive is dispersed in water, to the surface of the plate.

The honing roughening method is carried out by ejecting obliquely slurry, in which an abrasive is dispersed in water, with pressure applied from nozzles to the surface of the plate.

Examples of the abrasive include those generally used as abrasives such as volcanic ashes, alumina, or silicon carbide. The particle size of the abrasive is #200 to #3000, preferably #400 to #2000, and more preferably #600 to #1000.

After the plate has been roughened mechanically, it is preferably dipped in an acid or an aqueous alkali solution in order to remove abrasives and aluminum dust, etc. which have been embedded in the surface of the substrate or to control the shape of pits formed on the plate surface, whereby the surface is etched. Examples of the acid include sulfuric acid, persulfuric acid, hydrofluoric acid, phosphoric acid, nitric acid and hydrochloric acid, and examples of the alkali include sodium hydroxide and potassium hydroxide.

In the invention, the aluminum plate was mechanically surface roughened with an abrasive with a particle size of not less than #400, followed by etching treatment employing an aqueous alkali solution, whereby a complex surface structure formed due to the mechanical surface roughening treatment can be changed to a surface having a smooth convexoconcave structure. The resulting aluminum plate has a waviness of a relatively long wavelength of several microns to scores microns. The resulting aluminum plate further being subjected to electrolytic surface roughening treatment described later, an aluminum substrate is obtained which provides a good printing performance and good printing durability. Further, the aluminum plate can reduce a quantity of electricity during the electrolytic surface roughening treatment, contributing to cost reduction.

The resulting plate after dipped in the aqueous alkali solution is preferably subjected to neutralization treatment in an aqueous solution of an acid such as phosphoric acid, nitric acid, sulfuric acid, chromic acid, or in an aqueous solution of a mixture thereof. The electrolytic surface roughening after the neutralization is preferably carried out in the same acid solution as in the neutralization treatment.

The electrolytic surface roughening treatment in the invention is carried out in an acidic electrolytic solution employing an alternating current. As the acidic electrolytic solution, an acidic electrolytic solution used in a conventional electrolytic surface roughening treatment can be used, but a hydrochloric acid or nitric acid electrolytic solution is preferably used. In the invention, a hydrochloric acid electrolytic solution is especially preferably used.

As a current waveform used in the electrolytic surface roughening treatment, various waveforms such as a rectangular wave, trapezoidal wave, sawtooth wave or sine wave can be used, but sine wave is preferably used. Separated electrolytic surface roughening treatments disclosed in Japanese Patent O.P.I. Publication Nos. 10-869 are also preferably used.

In the electrolytic surface roughening treatment carried out using an electrolytic solution of nitric acid, voltage applied is preferably from 1 to 50 V, and more preferably from 5 to 30 V. The current density (in terms of peak value) used is preferably from 10 to 200 A/dm$^2$, and more preferably from 20 to 150 A/dm$^2$. The total quantity of electricity is preferably 100 to 2000 C/dm$^2$, more preferably 200 to 1500 C/dm$^2$, and most preferably 200 to 1000 C/dm$^2$. Temperature during the electrolytic surface roughening treatment is preferably from 10 to 50° C., and more preferably from 15 to 45° C. The nitric acid concentration in the electrolytic solution is preferably from 0.1% by weight to 5% by weight. It is possible to optionally add, to the electrolytic solution, nitrates, chlorides, amines, aldehydes, phosphoric acid, chromic acid, boric acid, acetic acid or oxalic acid.

In the electrolytic surface roughening treatment carried out using an electrolytic solution of hydrochloric acid, voltage applied is preferably from 1 to 50 V, and more preferably from 5 to 30 V. The current density (in terms of peak value) used is preferably from 10 to 200 A/dm$^2$, and more preferably from 20 to 150 A/dm$^2$. The total quantity of electricity is preferably 100 to 2000 C/dm$^2$, and more preferably 200 to 1000 C/dm$^2$. Temperature during the electrolytic surface roughening treatment is preferably from 10 to 50° C., and more preferably from 15 to 45° C. The hydrochloric acid concentration in the electrolytic solution is preferably from 0.1% by weight to 5% by weight. It is possible to optionally add, to the electrolytic solution, nitrates, chlorides, amines, aldehydes, phosphoric acid, chromic acid, boric acid, acetic acid or oxalic acid.

In the invention, the electrolytically surface roughened plate is dipped and subjected to etching treatment in an aqueous alkali or acid solution in order to remove aluminum dust produced on the plate surface, or to control the shape of pits formed on the plate surface, whereby the surface is etched. Examples of the acid solution include a solution of sulfuric acid, persulfuric acid, hydrofluoric acid, phosphoric acid, nitric acid, hydrochloric acid or another organic acid. Examples of the alkali solution include a solution of sodium hydroxide or potassium hydroxide.

The surface of the aluminum plate is etched in the aqueous alkali or acid solution, and the etching amount of the aluminum plate is preferably from 0.05 to 2.0 g/m$^2$. The etching amount not less than 0.05 g/m$^2$ removes smuts produced on the plate surface, and the etching amount not more than 2.0 g/m$^2$ smoothens the shape of pits formed during the electrolytic surface roughening treatment, contributing to improvement of printing durability.

The resulting plate after dipped in the aqueous alkali solution in the above is preferably subjected to neutralization treatment in an aqueous solution of an acid such as phosphoric acid, nitric acid, sulfuric acid, chromic acid, or in an aqueous solution of a mixture thereof. The anodization treatment after the neutralization treatment is carried out preferably in the same acid solution as in the neutralization treatment.

After the aluminum plate has been subjected to each of the surface treatments described above, it is subjected to anodization treatment. There is no restriction in particular for the method of anodization treatment used in the invention, and known methods can be used. The anodization treatment forms an anodization film on the surface of the aluminum plate. For the anodization treatment in the invention there is preferably used a method of carrying out electrolysis by applying a current density of from 1 to 10 A/dm$^2$ to an aqueous solution containing sulfuric acid and/or phosphoric acid in a concentration of from 10 to 50%, as an electrolytic solution. However, it is also possible to use a method of carrying out electrolysis by applying a high current density to sulfuric acid as described in U.S. Pat. No. 1,412,768, or a method of carrying out electrolysis in phosphoric acid as described in U.S. Pat. No. 3,511,661.

The aluminum plate, which has been subjected to anodization treatment, is optionally subjected to sealing treatment. For the sealing treatment, it is possible to use known sealing treatment carried out using hot water, boiling water, steam, an aqueous dichromate solution, a nitrite solution and an ammonium acetate solution.

The aluminum plate subjected to anodization treatment may be subjected to surface treatment other than the sealing treatment. Examples of the surface treatment include known treatments, which are carried out employing silicate, phosphate, various organic acids, or PVPA. Further, the aluminum plate subjected to anodization treatment may be subjected to surface treatment disclosed in Japanese Patent O.P.I. Publication No. 8-314157 in which the aluminum plate is treated in an aqueous bicarbonate solution or the aluminum plate is treated in an aqueous bicarbonate solution, followed by treatment in an organic acid solution such as an aqueous citric acid solution.

As one embodiment of the hydrophilic support used in the invention, there is a support in which a hydrophilic layer is provided on the substrate described above. The hydrophilic layer may be a single layer or plural layers. Material used in the hydrophilic layer is preferably a metal oxide.

The metal oxide is preferably metal oxide particles. Examples of the metal oxide particles include colloidal silica particles, an alumina sol, a titania sol and another metal oxide sol. The metal oxide particles may have any shape such as spherical, needle-like, and feather-like shape. The average particle size is preferably from 3 to 100 nm, and plural kinds of metal oxide each having a different size may be used in combination. The surface of the particles may be subjected to surface treatment.

The metal oxide particles can be used as a binder, utilizing its layer forming ability. The metal oxide particles are suitably used in a hydrophilic layer since they minimize lowering of the hydrophilicity of the layer as compared with an organic compound binder. Among the above-mentioned, colloidal silica is particularly preferred. The colloidal silica has a high layer forming ability under a drying condition with a relative low temperature, and can provide a good layer strength. It is preferred that the colloidal silica used in the invention is necklace-shaped colloidal silica or colloidal silica particles having an average particle size of not more than 20 nm, each being described later. Further, it is preferred that the colloidal silica provides an alkaline colloidal silica solution as a colloid solution.

The necklace-shaped colloidal silica to be used in the invention is a generic term of an aqueous dispersion system of spherical silica having a primary particle size of the order of nm. The necklace-shaped colloidal silica to be used in the invention means a "pearl necklace-shaped" colloidal silica formed by connecting spherical colloidal silica particles each having a primary particle size of from 10 to 50 μm so as to attain a length of from 50 to 400 nm. The term of "pearl necklace-shaped" means that the image of connected colloidal silica particles is like to the shape of a pearl necklace. The bonding between the silica particles forming the necklace-shaped colloidal silica is considered to be —Si—O—Si—, which is formed by dehydration of —SiOH groups located on the surface of the silica particles. Concrete examples of the necklace-shaped colloidal silica include Snowtex-PS series produced by Nissan Kagaku Kogyo, Co., Ltd.

As the products, there are Snowtex-PS-S (the average particle size in the connected state is approximately 110 nm), Snowtex-PS-M (the average particle size in the connected state is approximately 120 nm) and Snowtex-PS-L (the average particle size in the connected state is approximately 170 nm). Acidic colloidal silicas corresponding to each of the above-mentioned are Snowtex-PS-S-O, Snowtex-PS-M-O and Snowtex-PS-L-O, respectively.

The necklace-shaped colloidal silica is preferably used in a hydrophilic layer as a porosity providing material for hydrophilic matrix phase, and porosity and strength of the layer can be secured by its addition to the layer. Among them, the use of Snowtex-PS-S, Snowtex-PS-M or Snowtex-PS-L, each being alkaline colloidal silica particles, is particularly preferable since the strength of the hydrophilic layer is increased and occurrence of background contamination is inhibited even when a lot of prints are printed.

It is known that the binding force of the colloidal silica particles is become larger with decrease of the particle size. The average particle size of the colloidal silica particles to be used in the invention is preferably not more than 20 nm, and more preferably 3 to 15 nm. As above-mentioned, the alkaline colloidal silica particles show the effect of inhibiting occurrence of the background contamination. Accordingly, the use of the alkaline colloidal silica particles is particularly preferable.

Examples of the alkaline colloidal silica particles having the average particle size within the foregoing range include Snowtex-20 (average particle size: 10 to 20 nm), Snowtex-30 (average particle size: 10 to 20 nm), Snowtex-40 (average particle size: 10 to 20 nm), Snowtex-N (average particle size: 10 to 20 nm), Snowtex-S (average particle size: 8 to 11 nm) and Snowtex-XS (average particle size: 4 to 6 nm), each produced by Nissan Kagaku Co., Ltd.

The colloidal silica particles having an average particle size of not more than 20 nm, when used together with the necklace-shaped colloidal silica as described above, is particularly preferred, since appropriate porosity of the layer is maintained and the layer strength is further increased.

The ratio of the colloidal silica particles having an average particle size of not more than 20 nm to the necklace-shaped colloidal silica is preferably from 95/5 to 5/95, more preferably from 70/30 to 20/80, and most preferably from 60/40 to 30/70.

The hydrophilic layer of the printing plate material in the invention preferably contains porous metal oxide particles as metal oxides. Examples of the porous metal oxide particles include porous silica particles, porous aluminosilicate particles or zeolite particles as described later.

The porous silica particles are ordinarily produced by a wet method or a dry method. By the wet method, the porous silica particles can be obtained by drying and pulverizing a gel prepared by neutralizing an aqueous silicate solution, or pulverizing the precipitate formed by neutralization. By the dry method, the porous silica particles are prepared by combustion of silicon tetrachloride together with hydrogen and oxygen to precipitate silica. The porosity and the particle size of such particles can be controlled by variation of the production conditions.

The porous silica particles prepared from the gel by the wet method is particularly preferred.

The porous aluminosilicate particles can be prepared by the method described in, for example, JP O.P.I. No. 10-71764. Thus prepared aluminosilicate particles are amorphous complex particles synthesized by hydrolysis of aluminum alkoxide and silicon alkoxide as the major components. The particles can be synthesized so that the ratio of alumina to silica in the particles is within the range of from 1:4 to 4:1. Complex particles composed of three or more components prepared by an addition of another metal alkoxide may also be used in the invention. In such a particle, the porosity and the particle size can be controlled by adjustment of the production conditions.

The porosity of the particles is preferably not less than 1.0 ml/g, more preferably not less than 1.2 ml/g, and most preferably of from 1.8 to 2.5 ml/g, in terms of pore volume before the dispersion. The pore volume is closely related to water retention of the coated layer. As the pore volume increases, the water retention is increased, stain is difficult to occur, and water tolerance is high. Particles having a pore volume of more than 2.5 ml/g are brittle, resulting in lowering of durability of the layer containing them. Particles having a pore volume of less than 1.0 ml/g results in lowering of anti-stain property or water tolerance in printing.

The particle size of the particles dispersed in the hydrophilic layer (or in the dispersed state before formed as a layer) is preferably not more than 1 μm, and more preferably not more than 0.5 μm. Presence in the hydrophilic layer of particles with an extremely large size forms porous and sharp protrusions on the hydrophilic layer surface, and ink is likely to remain around the protrusions, which may produce stain at non-image portions of the printing plate and on the blanket of a press during printing.

Zeolite is a crystalline aluminosilicate, which is a porous material having voids of a regular three dimensional net work structure and having a pore size of 0.3 to 1 nm. Natural and synthetic zeolites are expressed by the following formula.

$$(M^1,(M^2)_{1/2})_m(Al_mSi_nO_{2(m+n)}).xH_2O$$

In the above, $M^1$ and $M^2$ are each exchangeable cations. Examples of $M^1$ include $Li^+$, $Na^+$, $K^+$, $Tl^+$, $Me_4N^+$ (TMA), $Et_4N^+$ (TEA), $Pr_4N^+$ (TPA), $C_7H_{15}N^{2+}$, and $C_8H_{16}N^+$, and examples of $M^2$ include $Ca^{2+}$, $Mg^{2+}$, $Ba^{2+}$, $Sr^{2+}$ and $(C_8H_{18}N)_2{}^{2+}$. Relation of n and m is $n \geqq m$, and consequently, the ratio of m/n, or that of Al/Si is not more than 1. A higher Al/Si ratio shows a higher content of the exchangeable cation, and a higher polarity, resulting in higher hydrophilicity. The Al/Si ratio is within the range of preferably from 0.4 to 1.0, and more preferably 0.8 to 1.0. x is an integer.

Synthetic zeolite having a stable Al/Si ratio and a sharp particle size distribution is preferably used as the zeolite particles to be used in the invention. Examples of such zeolite include Zeolite A: $Na_{12}(Al_{12}Si_{12}O_{48}).27H_2O$; Al/Si=1.0, Zeolite X: $Na_{86}(Al_{86}Si_{106}O_{384}).264H_2O$; Al/Si=0.811, and Zeolite Y: $Na_{56}(Al_{56}Si_{136}O_{384}).250H_2O$; Al/Si=0.412.

Containing the porous zeolite particles having an Al/Si ratio within the range of from 0.4 to 1.0 in the hydrophilic layer greatly raises the hydrophilicity of the hydrophilic layer itself, whereby contamination in the course of printing is inhibited and the water retention latitude is also increased. Further, contamination caused by a finger mark is also greatly reduced. When Al/Si is less than 0.4, the hydrophilicity is insufficient and the above-mentioned improving effects are lowered.

The size of the porous inorganic particles in the hydrophilic layer is preferably not more than 1 μm, and more preferably not more than 0.5 μm.

The hydrophilic layer of the printing plate material in the invention can contain layer structural clay mineral particles as a metal oxide. Examples of the layer structural clay mineral particles include a clay mineral such as kaolinite, halloysite, talk, smectite such as montmorillonite, beidellite, hectorite and saponite, vermiculite, mica and chlorite; hydrotalcite; and a layer structural polysilicate such as kanemite, makatite, ilerite, magadiite and kenyte. Among them, ones having a higher electric charge density of the unit layer are higher in the polarity and in the hydrophilicity. Preferable charge density is not less than 0.25, more preferably not less than 0.6. Examples of the layer structural mineral particles having such a charge density include smectite having a negative charge density of from 0.25 to 0.6 and bermiculite having a negative charge density of from 0.6 to 0.9. Synthesized fluorinated mica is preferable since one having a stable quality, such as the particle size, is available. Among the synthesized fluorinated mica, swellable one is preferable and one freely swellable is more preferable.

An intercalation compound of the foregoing layer structural mineral particles such as a pillared crystal, or one treated by an ion exchange treatment or a surface treatment such as a silane coupling treatment or a complication treatment with an organic binder is also usable.

The planar structural mineral particles are preferably in the plate form, and have an average particle size (an average of the largest particle length) of preferably not more than 20

μm, and an average aspect ratio (the largest particle length/the particle thickness) of preferably not less than 20, and more preferably not less than 50, in a state contained in the layer including the case that the particles are subjected to a swelling process and a dispersing layer-separation process. The particles more preferably have an average particle size of preferably not more than 5 μm, and an average aspect ratio of not less than 50, and still more preferably have an average particle size of preferably not more than 1 μm, and an average aspect ratio of not less than 50. When the particle size is within the foregoing range, continuity to the parallel direction, which is a trait of the layer structural particle, and softness, are given to the coated layer so that a strong dry layer in which a crack is difficult to be formed can be obtained. The coating solution containing the layer structural clay mineral particles in a large amount can minimize particle sedimentation due to a viscosity increasing effect. The particle size falling outside the above range may lower scratch resistance. The aspect ratio lower than the foregoing provides poor flexibility, and may lower scratch resistance.

The content of the layer structural clay mineral particles is preferably from 0.1 to 30% by weight, and more preferably from 1 to 10% by weight based on the total weight of the layer. Particularly, the addition of the swellable synthesized fluorinated mica or smectite is effective if the adding amount is small. The layer structural clay mineral particles may be added in the form of powder to a coating liquid, but it is preferred that gel of the particles which is obtained by being swelled in water, is added to the coating liquid in order to obtain a good dispersity according to an easy coating liquid preparation method which requires no dispersion process comprising dispersion due to media.

An aqueous solution of a silicate is also usable as another additive to the hydrophilic matrix phase in the invention. An alkali metal silicate such as sodium silicate, potassium silicate or lithium silicate is preferable, and the $SiO_2/M_2O$ is preferably selected so that the pH value of the coating liquid after addition of the silicate exceeds 13 in order to prevent dissolution of the porous metal oxide particles or the colloidal silica particles.

An inorganic polymer or an inorganic-organic hybrid polymer prepared by a sol-gel method employing a metal alkoxide. Known methods described in S. Sakka "Application of Sol-Gel Method" or in the publications cited in the above publication can be applied to prepare the inorganic polymer or the inorganic-organic hybridpolymer by the sol-gel method.

In the invention, the hydrophilic matrix phase preferably contains a water soluble resin. Examples of the water soluble resin include polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylamide, and polyvinyl pyrrolidone.

A cationic resin may also be contained in the hydrophilic layer. Examples of the cationic resin include a polyalkylenepolyamine such as a polyethyleneamine or polypropylenepolyamine or its derivative, an acryl resin having a tertiary amino group or a quaternary ammonium group and diacrylamine. The cationic resin may be added in a form of fine particles. Examples of such particles include the cationic microgel described in Japanese Patent O.P.I. Publication No. 6-161101.

In the invention, it is preferred that the hydrophilic organic resin contained in the hydrophilic layer is a water soluble resin, and at least a part of the resin exists in the hydrophilic layer in a state capable of being dissolved in water. However, if the water soluble resin is cross-linked by a crosslinking agent and is insoluble in water, its hydrophilicity is lowered, resulting in problem of lowering printing performance.

The water soluble resin in the hydrophilic layer is preferably a saccharide. Inclusion of the saccharide in the hydrophilic layer in combination with an image formation layer described later provides high resolving power and high printing durability.

As the saccharides, oligosaccharide detailed later can be used, but polysaccharides are preferably used.

As the polysaccharide, starches, celluloses, polyuronic acid and pullulan can be used. Among them, a cellulose derivative such as a methyl cellulose salt, a carboxymethyl cellulose salt or a hydroxyethyl cellulose salt is preferable, and a sodium or ammonium salt of carboxymethyl cellulose is more preferable. These polysaccharides can form a preferred surface shape of the hydrophilic layer.

The surface of the hydrophilic layer preferably has a convexoconcave structure having a pitch of from 0.1 to 50 μm such as the grained aluminum surface of an aluminum PS plate. The water retention ability and the image maintaining ability are raised by such a convexoconcave structure of the surface. Such a convexoconcave structure can also be formed by adding in an appropriate amount a filler having a suitable particle size to the coating liquid of the hydrophilic layer. However, the convexoconcave structure is preferably formed by coating a coating liquid for the hydrophilic layer containing the alkaline colloidal silica and the water-soluble polysaccharide so that the phase separation occurs at the time of drying the coated liquid, whereby a structure is obtained which provides a good printing performance.

The shape of the convexoconcave structure such as the pitch and the surface roughness thereof can be suitably controlled by the kinds and the adding amount of the alkaline colloidal silica particles, the kinds and the adding amount of the water-soluble polysaccharide, the kinds and the adding amount of another additive, a solid concentration of the coating liquid, a wet layer thickness or a drying condition.

The pitch in the convexoconcave structure is preferably from 0.2 to 30 μm, and more preferably from 0.5 to 20 μm. A multi-layered convexoconcave structure may be formed in which a convexoconcave structure with a smaller pitch is formed on one with a larger pitch.

The hydrophilic layer has a surface roughness Ra of preferably from 100 to 1000 nm, and more preferably from 150 to 600 nm.

The thickness of the hydrophilic layer is from 0.01 to 50 μm, preferably from 0.2 to 10 μm, and more preferably from 0.5 to 3 μm.

A water-soluble surfactant may be added for improving the coating ability of the coating liquid for the hydrophilic layer in the invention. A silicon atom-containing surfactant and a fluorine atom-containing surfactant are preferably used. The silicon atom-containing surfactant is especially preferred in that it minimizes printing contamination. The content of the surfactant is preferably from 0.01 to 3% by weight, and more preferably from 0.03 to 1% by weight based on the total weight of the hydrophilic layer (or the solid content of the coating liquid).

The hydrophilic layer in the invention can contain a phosphate. Since a coating liquid for the hydrophilic layer is preferably alkaline, the phosphate to be added to the hydrophilic layer is preferably sodium phosphate or sodium monohydrogen phosphate. The addition of the phosphate provides improved reproduction of dots at shadow portions. The content of the phosphate is preferably from 0.1 to 5% by weight, and more preferably from 0.5 to 2% by weight in terms of amount excluding hydrated water.

The hydrophilic layer preferably contains a light-to-heat conversion material. The light-to-heat conversion material content of the hydrophilic layer is preferably from 0.1 to 80% by weight, and more preferably from 1 to 60% by weight.

Examples of the light-to-heat conversion material include the following substances:

Examples of the light-to-heat conversion material include a general infrared absorbing dye such as a cyanine dye, a chloconium dye, a polymethine dye, an azulenium dye, a squalenium dye, a thiopyrylium dye, a naphthoquinone dye or an anthraquinone dye, and an organometallic complex such as a phthalocyanine compound, a naphthalocyanine compound, an azo compound, a thioamide compound, a dithiol compound or an indoaniline compound. Exemplarily, the light-to-heat conversion materials include compounds disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds may be used singly or in combination.

Compounds described in Japanese Patent O.P.I. Publication Nos. 11-240270, 11-265062, 2000-309174, 2002-49147, 2001-162965, 2002-144750, and 2001-219667 can be preferably used.

Examples of pigment include carbon, graphite, a metal and a metal oxide. Furnace black and acetylene black is preferably used as the carbon. The graininess ($d_{50}$) thereof is preferably not more than 100 nm, and more preferably not more than 50 nm.

The graphite is one having a particle size of preferably not more than 0.5 μm, more preferably not more than 100 nm, and most preferably not more than 50 nm.

As the metal, any metal can be used as long as the metal is in a form of fine particles having preferably a particle size of not more than 0.5 μm, more preferably not more than 100 nm, and most preferably not more than 50 nm. The metal may have any shape such as spherical, flaky and needle-like. Colloidal metal particles such as those of silver or gold are particularly preferred.

As the metal oxide, materials having black color in the visible regions or materials which are electro-conductive or semi-conductive can be used. Examples of the former include black iron oxide and black complex metal oxides containing at least two metals. Examples of the latter include Sb-doped $SnO_2$ (ATO), Sn-added $In_2O_3$ (ITO), $TiO_2$, TiO prepared by reducing $TiO_2$ (titanium oxide nitride, generally titanium black). Particles prepared by covering a core material such as $BaSO_4$, $TiO_2$, $9Al_2O_3.2B_2O$ and $K_2O.nTiO_2$ with these metal oxides is usable. These oxides are particles having a particle size of preferably not more than 0.5 μm, more preferably not more than 100 nm, and most preferably not more than 50 nm.

As these light-to-heat conversion materials, black iron oxide or black complex metal oxides containing at least two metals are more preferred.

The black iron oxide ($Fe_3O_4$) particles have an average particle size of from 0.01 to 1 μm, and an acicular ratio (major axis length/minor axis length) of preferably from 1 to 1.5. It is preferred that the black iron oxide particles are substantially spherical ones (having an acicular ratio of 1) or octahedral ones (having an acicular ratio of 1.4).

Examples of the black iron oxide particles include for example, TAROX series produced by Titan Kogyo K.K. Examples of the spherical particles include BL-100 (having a particle size of from 0.2 to 0.6 μm, and BL-500 (having a particle size of from 0.3 to 1.0 μm. Examples of the octahedral particles include ABL-203 (having a particle size of from 0.4 to 0.5 μm, ABL-204 (having a particle size of from 0.3 to 0.4 μm, ABL-205 (having a particle size of from 0.2 to 0.3 μm, and ABL-207 (having a particle size of 0.2 μm.

The black iron oxide particles may be surface-coated with inorganic compounds such as $SiO_2$. Examples of such black iron oxide particles include spherical particles BL-200 (having a particle size of from 0.2 to 0.3 μm) and octahedral particles ABL-207A (having a particle size of 0.2 μm), each having been surface-coated with $SiO_2$.

Examples of the black complex metal oxides include complex metal oxides comprising at least two selected from Al, Ti, Cr, Mn, Fe, Co, Ni, Cu, Zn, Sb, and Ba. These can be prepared according to the methods disclosed in Japanese Patent O.P.I. Publication Nos. 9-27393, 9-25126, 9-237570, 9-241529 and 10-231441.

The complex metal oxide used in the invention is preferably a complex Cu—Cr—Mn type metal oxide or a Cu—Fe—Mn type metal oxide. The Cu—Cr—Mn type metal oxides are preferably subjected to the treatment disclosed in Japanese Patent O.P.I. Publication Nos. 8-27393 in order to reduce isolation of a 6-valent chromium ion. These complex metal oxides have a high color density and a high light heat conversion efficiency as compared with another metal oxide.

The primary average particle size of these complex metal oxides is preferably from 0.001 to 1.0 μm, and more preferably from 0.01 to 0.5 μm. The primary average particle size of from 0.001 to 1.0 μm improves a light heat conversion efficiency relative to the addition amount of the particles, and the primary average particle size of from 0.05 to 0.5 μm further improves a light heat conversion efficiency relative to the addition amount of the particles. The light heat conversion efficiency relative to the addition amount of the particles depends on a dispersity of the particles, and the well-dispersed particles have a high light heat conversion efficiency. Accordingly, these complex metal oxide particles are preferably dispersed according to a known dispersing method, separately to a dispersion liquid (paste), before being added to a coating liquid for the particle containing layer. The metal oxides having a primary average particle size of less than 0.001 are not preferred since they are difficult to disperse. A dispersant is optionally used for dispersion. The addition amount of the dispersant is preferably from 0.01 to 5% by weight, and more preferably from 0.1 to 2% by weight, based on the weight of the complex metal oxide particles.

In the invention, a preferred printing plate material is one which comprises a substrate with a hydrophilic layer surface or a hydrophilic layer, and provided thereon, an image formation layer capable of being developed on a press. The image formation layer is preferably a layer wherein an image is formed by heat generated due to infrared laser exposure.

One preferred embodiment of the image formation layer in the invention contains a hydrophobe precursor.

As the hydrophobe precursor can be used a polymer whose property is capable of changing from a hydrophilic property (a water dissolving property or a water swelling property) or to a hydrophobic property by heating. Examples of the hydrophobe precursor include a polymer having an aryldiazosulfonate unit as disclosed in for example, Japanese Patent O.P.I. Publication No. 200-56449.

In the invention, the hydrophobe precursor is preferably thermoplastic hydrophobic particles or microcapsules encapsulating a hydrophobic compound.

As the thermoplastic hydrophobic particles, there are heat melting particles or heat fusible particles, as described later.

The heat melting particles used in the invention are particularly particles having a low melt viscosity, which are particles formed from materials generally classified into wax. The materials preferably have a softening point of from 40° C. to 120° C. and a melting point of from 60° C. to 150° C., and more preferably a softening point of from 40° C. to 100° C. and a melting point of from 60° C. to 120° C. The melting point less than 60° C. has a problem in storage stability and the melting point exceeding 300° C. lowers ink receptive sensitivity.

Materials usable include paraffin, polyolefin, polyethylene wax, microcrystalline wax, and fatty acid wax. The molecular weight thereof is approximately from 800 to 10,000. A polar group such as a hydroxyl group, an ester group, a carboxyl group, an aldehyde group and a peroxide group may be introduced into the wax by oxidation to increase the emulsification ability. Moreover, stearoamide, linolenamide, laurylamide, myristylamide, hardened cattle fatty acid amide, parmitylamide, oleylamide, rice bran oil fatty acid amide, palm oil fatty acid amide, a methylol compound of the above-mentioned amide compounds, methylenebissteastearoamide and ethylenebissteastearoamide may be added to the wax to lower the softening point or to raise the working efficiency. A cumarone-indene resin, a rosin-modified phenol resin, a terpene-modified phenol resin, a xylene resin, a ketone resin, an acryl resin, an ionomer and a copolymer of these resins may also be usable.

Among them, polyethylene, microcrystalline wax, fatty acid ester and fatty acid are preferably contained. A high sensitive image formation can be performed since these materials each have a relative low melting point and a low melt viscosity. These materials each have a lubrication ability. Accordingly, even when a shearing force is applied to the surface layer of the printing plate precursor, the layer damage is minimized, and resistance to stain which may be caused by scratch is further enhanced.

The heat melting particles are preferably dispersible in water. The average particle size thereof is preferably from 0.01 to 10 μm, and more preferably from 0.1 to 3 μm. When a layer containing the heat melting particles is coated on the porous hydrophilic layer, the particles having an average particle size less than 0.01 μm may enter the pores of the hydrophilic layer or the valleys between the neighboring two peaks on the hydrophilic layer surface, resulting in insufficient development-on-press and in stain occurrence at the background. The particles having an average particle size exceeding 10 μm may result in lowering of dissolving power.

The composition of the heat melting particles may be continuously varied from the interior to the surface of the particles. The particles may be covered with a different material. Known microcapsule production method or sol-gel method can be applied for covering the particles. The heat melting particle content of the layer is preferably 1 to 90% by weight, and more preferably 5 to 80% by weight based on the total layer weight.

The heat fusible particles in the invention include thermoplastic hydrophobic polymer particles. Although there is no specific limitation to the upper limit of the softening point of the thermoplastic hydrophobic polymer, the softening point is preferably lower than the decomposition temperature of the polymer. The weight average molecular weight (Mw) of the thermoplastic hydrophobic polymer is preferably within the range of from 10,000 to 1,000,000.

Examples of the polymer consisting the polymer particles include a diene (co)polymer such as polypropylene, polybutadiene, polyisoprene or an ethylene-butadiene copolymer; a synthetic rubber such as a styrene-butadiene copolymer, a methyl methacrylate-butadiene copolymer or an acrylonitrile-butadiene copolymer; a (meth)acrylate (co)polymer or a (meth)acrylic acid (co)polymer such as polymethyl methacrylate, a methyl methacrylate-(2-ethylhexyl)acrylate copolymer, a methyl methacrylate-methacrylic acid copolymer, or a methyl acrylate-(N-methylolacrylamide); polyacrylonitrile; a vinyl ester (co)polymer such as a polyvinyl acetate, a vinyl acetate-vinyl propionate copolymer and a vinyl acetate-ethylene copolymer, or a vinyl acetate-2-hexylethyl acrylate copolymer; and polyvinyl chloride, polyvinylidene chloride, polystyrene and a copolymer thereof. Among them, the (meth)acrylate polymer, the (meth)acrylic acid (co)polymer, the vinyl ester (co)polymer, the polystyrene and the synthetic rubbers are preferably used.

The polymer particles may be prepared from a polymer synthesized by any known method such as an emulsion polymerization method, a suspension polymerization method, a solution polymerization method and a gas phase polymerization method. The particles of the polymer synthesized by the solution polymerization method or the gas phase polymerization method can be produced by a method in which an organic solution of the polymer is sprayed into an inactive gas and dried, and a method in which the polymer is dissolved in a water-immiscible solvent, then the resulting solution is dispersed in water or an aqueous medium and the solvent is removed by distillation. In both of the methods, a surfactant such as sodium lauryl sulfate, sodium dodecylbenzenesulfate or polyethylene glycol, or a water-soluble resin such as poly(vinyl alcohol) may be optionally used as a dispersing agent or stabilizing agent.

The heat fusible particles are preferably dispersible in water. The average particle size of the heat fusible particles is preferably from 0.01 to 10 μm, and more preferably from 0.1 to 3 μm. When a layer containing the heat fusible particles having an average particle size less than 0.01 μm is coated on the porous hydrophilic layer, the particles may enter the pores of the hydrophilic layer or the valleys between the neighboring two peaks on the hydrophilic layer surface, resulting in insufficient development-on-press and in background contamination. The heat fusible particles having an average particle size exceeding 10 μm result in lowering of dissolving power.

Further, the composition of the heat fusible particles may be continuously varied from the interior to the surface of the particles. The particles may be covered with a different material. As a covering method, known methods such as a microcapsule method and a sol-gel method are usable. The heat fusible particle content of the layer is preferably from 1 to 90% by weight, and more preferably from 5 to 80% by weight based on the total weight of the layer.

Microcapsules used in the printing plate material in the invention include those encapsulating oleophilic materials disclosed in Japanese Patent O.P.I. Publication Nos. 2002-2135 and 2002-19317.

The average microcapsule size of the microcapsules is preferably from 0.1 to 10 μm, more preferably from 0.3 to 5 μm, and still more preferably from 0.5 to 3 μm. The thickness of the microcapsule wall is preferably from 1/100 to 1/5 of the average microcapsule size, and more preferably from 1/50 to 1/10 of the average microcapsule size. The microcapsule content of the image formation layer is preferably from 5 to 100% by weight, more preferably from 20 to 95% by weight, and most preferably from 40 to 90% by weight.

As the materials for the microcapsule wall, known materials can be used. As a method of manufacturing the microcapsules, known methods can be used. The materials for the microcapsule wall and the manufacturing method of the microcapsule wall can be applied which are disclosed in for example, Tamotsu Kondo, Masumi Koishi, "New Edition Microcapsule, Its Manufacturing Method, Properties And Application", published by Sankyo Shuppan Co., Ltd., or disclosed in literatures cited in it.

It is preferred that the image formation layer in the invention further contain the following substances.

The image formation layer preferably contains the light-to-heat conversion materials described above. The light-to-heat conversion material content of the image formation layer is preferably from 0.1 to 50% by weight, and more preferably from 1 to 30% by weight.

The image formation layer preferably contains a substance with a low color density, e.g., a dye, since a part thereof is developed on a printing press.

The image formation layer can contain water soluble resins or water dispersible resins. Water soluble resins or water dispersible resins include oligosaccharides, polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylic acid, polyacrylic acid salts, polyacrylamide, and polyvinyl pyrrolidone. Among these, oligosaccharides, polysaccharides or polyacrylic acid are preferred. Examples of the oligosaccharides include raffinose, trehalose, maltose, galactose, sucrose, and lactose. Among these, trehalose is preferred. Examples of the polysaccharides include starches, celluloses, polyuronic acid and pullulan. Among these, cellulose derivatives such as a methyl cellulose salt, a carboxymethyl cellulose salt and a hydroxyethyl cellulose salt are preferred, and a sodium or ammonium salt of carboxymethyl cellulose is more preferred. The polyacrylic acid has a molecular weight of preferably from 3,000 to 1,000,000, and more preferably from 5,000 to 500,000.

A water-soluble surfactant may be contained in the image formation layer in the invention. A silicon atom-containing surfactant and a fluorine atom-containing surfactant can be used. The silicon atom-containing surfactant is especially preferred in that it minimizes printing contamination. The content of the surfactant is preferably from 0.01 to 3.0% by weight, and more preferably from 0.03 to 1.0% by weight based on the total weight of the image formation layer (or the solid content of the coating liquid).

The image formation layer in the invention can contain an acid (phosphoric acid or acetic acid) or an alkali (sodium hydroxide, silicate, or phosphate) to adjust pH.

The coating amount of the image formation layer is from 0.01 to 10 g/m$^2$, preferably from 0.1 to 3 g/m$^2$, and more preferably from 0.2 to 2 g/m$^2$.

A protective layer can be provided on the image formation layer. As materials in the protective layer, the water soluble resin or the water dispersible resin described above can be preferably used. The protective layer in the invention may be a hydrophilic overcoat layer disclosed in Japanese Patent O.P.I. Publication Nos. 2002-19318 and 2002-86948.

The coating amount of the protective layer is from 0.01 to 10 g/m$^2$, preferably from 0.1 to 3 g/m$^2$, and more preferably from 0.2 to 2 g/m$^2$.

In the printing plate material comprising the image formation layer, the image formation layer at portions exposed by for example, infrared laser form image portions laser, and the image formation layer at unexposed portions are removed to form non-image portions. Removal of the image formation layer can be carried out by washing with water, and can be also carried out by supplying water and/or printing ink to the image formation layer of the printing plate material on a press (so-called development-on-press).

Removal on a press of the image formation layer at unexposed portions of a printing plate material, which is mounted on the plate cylinder, can be carried out by bringing a dampening roller and an inking roller into contact with the image formation layer while rotating the plate cylinder, and can be also carried out according to various sequences such as those described below or another appropriate sequence. The supplied amount of dampening water may be adjusted to be greater or smaller than the amount ordinarily supplied in printing, and the adjustment may be carried out stepwise or continuously.

(1) A dampening roller is brought into contact with the image formation layer of a printing plate material on the plate cylinder during one to several tens of rotations of the plate cylinder, and then an inking roller brought into contact with the image formation layer during the next one to tens of rotations of the plate cylinder. Thereafter, printing is carried out.

(2) An inking roller is brought into contact with the image formation layer of a printing plate material on the plate cylinder during one to several tens of rotations of the plate cylinder, and then a dampening roller brought into contact with the image formation layer during the next one to tens of rotations of the plate cylinder. Thereafter, printing is carried out.

(3) An inking roller and a dampening roller are brought into contact with the image formation layer of a printing plate material on the plate cylinder during one to several tens of rotations of the plate cylinder. Thereafter, printing is carried out.

EXAMPLES

Preparation of Support 1

A 0.24 mm thick aluminum plate (1050, H16) was immersed in an aqueous 1% by weight sodium hydroxide solution at 50° C. to give an aluminum dissolution amount of 2 g/m$^2$, washed with water, immersed in an aqueous 0.1% by weight hydrochloric acid solution at 25° C. for 30 seconds to neutralize, and then washed with water.

Subsequently, the aluminum plate was subjected to an electrolytic surface-roughening treatment in an electrolytic solution containing 10 g/liter of hydrochloric acid and 0.5 g/liter of aluminum at a peak current density of 60 A/dm$^2$ employing an alternating current with a sine waveform, in which the distance between the plate surface and the electrode was 10 mm. The electrolytic surface-roughening treatment was divided into 12 treatments, in which the quantity of electricity used in one treatment (at a positive polarity) was 40 C/dm$^2$, and the total quantity of electricity used (at a positive polarity) was 480 C/dm$^2$. Standby time of 4 seconds, during which no surface-roughening treatment was carried out, was provided after each of the separate electrolytic surface-roughening treatments.

Subsequently, the resulting aluminum plate was immersed in an aqueous 1% by weight sodium hydroxide solution at 50° C. and etched to give an aluminum etching amount (including smut produced on the surface) of 0.2 g/m$^2$, washed with water, neutralized in an aqueous 10% by weight sulfuric acid solution at 25° C. for 10 seconds, and washed with water. Subsequently, the aluminum plate was subjected to anodizing treatment in an aqueous 20% by weight sulfuric acid solution at a constant voltage of 20 V, in which a quantity of electricity of 150 C/dm$^2$ was supplied, and washed with water.

The washed surface of the plate was squeegeed, and the plate was immersed in an aqueous 0.5% by weight disodium hydrogen phosphate solution at 70° C. for 30 seconds, washed with water, and dried at 80° C. for 5 minutes. Thus, the support 1 was obtained.

The surface roughness of the support 1 was determined at a magnifying power of 40 employing a surface roughness measuring apparatus RSTPLUS, manufactured by WYKO Co., Ltd. The support 1 had a surface roughness Ra of 0.55 μm.

Preparation of Support 2

A 188 μm thick polyethylene terephthalate film HS74 (produced by Teijin Co., Ltd.) with a subbing layer for coating an aqueous coating liquid was used as support 2

Examples 1 through 5 and Comparative Examples 1 and 2

Preparation of planographic printing plate material samples 1-1 and 1-2.

The image formation layer (a) coating solution having a composition as shown in Table 1 was coated on the support 1 employing a wire bar to give an image formation layer with a dry thickness of 0.7 g/m$^2$, dried at 50° C. for three minutes, and then subjected to aging treatment at 40° C. for 48 hours. Thus, planographic printing plate material samples 1-1 and 1-2 were obtained.

Composition of image Formation Layer (a) Coating Solution (Having a Solid Content of 6% by Weight)

TABLE 1

| | |
|---|---|
| Carnauba wax emulsion A118 (the wax having an average particle size of 0.3 μm, and having a solid content of 40% by weight, produced by Gifu Shellac Co., Ltd.) | 12.30 parts by weight |
| Aqueous solution of trehalose powder Treha (mp. 97° C., produced by Hayashihara Shoji Co., Ltd.) having a solid content of 10% by weight | 9.00 parts by weight |
| Light-to-heat conversion dye ADS830WS (Produced by American Dye Source Co., Ltd.) | 18.00 parts by weight |
| Pure water | 60.70 parts by weight |

Preparation of Planographic Printing Plate Material Samples 2-1 and 2-2

Paste (A) having the following composition was prepared. Materials as shown in Table 2 were added to pure water while stirring, and the resulting mixture was stirred at a rotation speed of 10,000 rpm for 5 minutes in a homogenizer to give a paste having a solid content of 40% by weight.

Composition of Paste (A)

TABLE 2

| | |
|---|---|
| Spherical black iron oxide particles BL-200 (produced by Titan Kogyo K.K., black iron oxide/amorphous silica = 98.5/1.5, average particle size: 0.2–0.3 μm, acicular ratio: substantially 1, specific surface area: 9.0 m$^2$/g, Hc: 11.2 kA/m, σs: 83.1 Am$^2$/kg, σr/σs: 0.130) | 28.24 parts by weight |
| Layer structural clay mineral particles Montmorillonite: Mineral Colloid MO gel prepared by vigorously stirring Mineral Colloid MO (average particle size: 0.1 μm, produced by Southern Clay Products Co., Ltd.) in water in a homogenizer to give a solid content of 5% by weight | 28.24 parts by weight |
| Aqueous 10% by weight sodium phosphate.dodecahydrate solution (Reagent produced by Kanto Kagaku Co., Ltd.) | 3.52 parts by weight |
| Pure water | 40.00 parts by weight |

Materials as shown in Table 3 were mixed and stirred and filtered to obtain an under layer coating solution having a solid content of 20% by weight.

Composition of Under Layer Coating Solution

TABLE 3

| | |
|---|---|
| Paste (A) | 28.33 parts by weight |
| Porous metal oxide particles Silton JC 50 (porous aluminosilicate particles having an average particle size of 5 μm, produced by Mizusawa Kagaku Co., Ltd.) | 2.00 parts by weight |
| Colloidal silica (alkali type): Snowtex XS (solid 20% by weight, produced by Nissan Kagaku Co., Ltd.) | 47.40 parts by weight |
| Surfactant: 1% by weight Surfinol 465 (Air Products Co., Ltd.) aqueous solution | 2.00 parts by weight |
| Pure water | 20.27 parts by weight |

Materials as shown in Table 4 were mixed and stirred at a rotation speed of 10,000 rpm for 10 minutes in a homogenizer to give a hydrophilic layer coating solution having a solid content of 10% by weight.

Composition of Hydrophilic Layer Coating Solution

TABLE 4

| | |
|---|---|
| Cu—Fe—Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40.5% by weight (including 0.5% by weight of dispersant)} | 2.50 parts by weight |
| Colloidal silica (alkali type): Snowtex S (solid 30% by weight, produced by Nissan Kagaku Co., Ltd.) | 8.87 parts by weight |
| Necklace shaped colloidal silica (alkali type): Snowtex PSM (solid 20% by weight, produced by Nissan Kagaku Co., Ltd.) | 19.95 parts by weight |
| Porous metal oxide particles Silton AMT 08 (porous aluminosilicate particles having an average particle size of 0.6 μm, produced by Mizusawa Kagaku Co., Ltd.) | 1.00 parts by weight |
| Porous metal oxide particles Silton JC20 (porous aluminosilicate particles having an average particle size of 2 μm, produced by Mizusawa Kagaku Co., Ltd.) | 1.00 parts by weight |
| Layer structural clay mineral particles: Montmorillonite Mineral Colloid MO gel prepared by vigorously stirring montmorillonite Mineral | 4.00 parts by weight |

TABLE 4-continued

| | |
|---|---|
| Colloid MO; gel produced by Southern Clay Products Co., Ltd. (average particle size: 0.1 μm) in water in a homogenizer to give a solid content of 5% by weight | |
| Aqueous 4% by weight sodium carboxymethyl cellulose solution (Reagent produced by Kanto Kagaku Co., Ltd.) | 2.50 parts by weight |
| Aqueous 10% by weight sodium phosphate·dodecahydrate solution (Reagent produced by Kanto Kagaku Co., Ltd. | 0.50 parts by weight |
| Pure water | 59.68 parts by weight |

The under layer coating solution was coated on the subbing layer of the support 2 employing a wire bar to give an under layer having a dry thickness of 2.5 g/m$^2$, and dried at 100° C. for 3 minutes.

Subsequently, the hydrophilic layer coating solution was coated on the under layer employing a wire bar to give a hydrophilic layer having a dry thickness of 0.6 g/m$^2$, and dried at 100° C. for 3 minutes, and then subjected to aging at 60° C. for 24 hours.

Subsequently, the image formation layer coating solution (b) having the following composition was coated on the hydrophilic layer employing a wire bar to give an image formation layer having a dry thickness of 0.6 g/m$^2$, and dried at 55° C. for 3 minutes, and then subjected to aging at 55° C. for 24 hours. Thus, printing plate material samples 2-1 and 2-1 were prepared.

Composition of Image Formation Layer Coating Solution (b) (Having a Solid Content of 6% by Weight)

TABLE 5

| | |
|---|---|
| Carnauba wax emulsion A118 (the wax having an average particle size of 0.3 μm, a softening point of 65° C., a melting point of 80° C., a melt viscosity at 140° C. of 8 cps, and having a solid content of 40% by weight, produced by Gifu Shellac Co., Ltd.) | 10.50 parts by weight |
| Trehalose powder solution (Treha mp. 97° C., produced by Hayashihara Shoji Co., Ltd.) having a solid content of 10% by weight | 18.00 parts by weight |
| Pure water | 71.50 parts by weight |

Each sample obtained above was mounted on an exposure drum. Image formation was carried out by infrared laser exposure. Exposure was carried out employing an infrared laser (having a wavelength of 830 nm and a beam spot diameter of 18 μm) at an exposure energy of 300 mJ/cm$^2$, at a resolution of 2400 dpi and at a screen line number of 175 to form a solid image, a dot image with an dot area of 1 to 99%, and a line and space image of 2400 dpi. The term, "dpi" herein shows the number of dots per 1 inch or 2.54 cm.

The exposed printing plate material sample (first sample) was mounted on a plate cylinder of a printing press, DAIYA 1F-1 produced by Mitsubishi Jukogyo Co., Ltd. Printing was carried out employing a coated paper, dampening water, a 2% by weight solution of Astromark 3 (produced by Nikken Kagaku Kenkyusyo Co., Ltd.), and printing ink (Toyo King Hyecho M Magenta, produced by Toyo Ink Manufacturing Co.).

Printing was stopped, and the sample was dismounted from the plate cylinder.

Subsequently, washing of the surface of the blanket cylinder was carried out as follows. A non-woven fabric roll (Super Pack) impregnated with a cleaning solution with low volatility used in a cylinder washing device IMPACT produced by Baldwin Co., Ltd. was employed for washing the blanket cylinder. The non-woven fabric was fed 15 cm by length and pressed against the blanket cylinder for 3 minutes employing a bar, while rotating the blanket cylinder to wash the blanket cylinder.

Subsequently, the following drying step (0), (1), (2) or (3) was carried out.

(0) No drying step was carried out.

(1) A dry non-woven fabric was fed 30 cm by length and pressed against the blanket cylinder surface for 3 minutes through a bar, while slowly rotating the blanket cylinder, whereby the cleaning solution on the blanket cylinder surface was wiped off and the blanket cylinder was dried.

(2) 70 $^{2o}$ C. air was blown onto the blanket cylinder surface for 3 minutes while slowly rotating the blanket cylinder to dry it.

(3) Printing was carried out while five printing paper sheets were fed, but without supplying dampening water or printing ink, whereby the cleaning solution on the blanket cylinder surface was transferred to the paper sheets and the blanket cylinder was dried.

Subsequently, the exposed printing plate material sample (second sample) was mounted on the plate cylinder of a printing press by the following printing plate material mounting method (1) or (2).

Printing Plate Material Mounting Method 1:

The leading edge of the printing plate material sample being gripped by the leading edge plate gripper of the plate cylinder, the sample was nipped between the plate cylinder and a blanket cylinder, and the plate cylinder was rotated in such a direction that the sample was wound around the plate cylinder while holding the trailing edge of the printing plate material by hand, and then the trailing edge of the sample was gripped by means of the trailing edge plate gripper of the plate cylinder while contacting the blanket cylinder surface with the sample surface. After appropriate tension was applied, the sample was fixed onto the plate cylinder.

Printing Plate Material Mounting Method 2:

The leading edge of the printing plate material sample being gripped by the leading edge plate gripper of the plate cylinder, the plate cylinder was rotated in such a direction that the sample was wound around the plate cylinder while pulling the trailing edge of the sample by hand, in which the sample was not nipped by the plate cylinder and a blanket cylinder, and then the sample was wound around the plate cylinder substantially without contacting the blanket cylinder surface with the sample surface. Then, the trailing edge of the sample was gripped by means of the trailing edge plate gripper of the plate cylinder. After appropriate tension was applied, the sample was fixed against the plate cylinder.

Next, printing was carried out. As a sequence at the beginning of printing, the plate cylinder was rotated three times while bringing a dampening roller into contact with the printing plate material sample, then, the plate cylinder was rotated two times while bringing an inking roller into contact with the printing plate material sample, and then the plate cylinder was brought into contact with the blanket cylinder, thus, printing was started.

Printing plate material samples 1-1 and 2-1 were used as the first sample, and printing plate material samples 1-2 and 2-2 were used as the second sample.

Printing was carried out employing combinations of the printing plate material sample, the drying steps and the printing plate material sample mounting methods as shown in Table 6 below. Each of the printing processes above was evaluated for developability on a press below.

[Evaluation of Developability on a Press]

With respect to the printing plate material samples 1-2 and 2-2, the number of paper sheets, which were printed from when printing started till when a print without stain at non-image portions and with a reproduced dot image with a dot area of 90% was obtained, was counted and evaluated as a measure of developability on a press.

The results are shown in Table 6.

TABLE 6

| | Printing plate material sample | Drying step | Printing plate material mounting method | Developability on a press (Number) |
|---|---|---|---|---|
| Example 1 | 2-1, 2-2 | (1) | (1) | 10 |
| Example 2 | 2-1, 2-2 | (1) | (2) | 10 |
| Example 3 | 2-1, 2-2 | (2) | (1) | 10 |
| Example 4 | 1-1, 1-2 | (3) | (1) | 10 |
| Example 5 | 2-1, 2-2 | (3) | (1) | 10 |
| Comparative Example 1 | 2-1, 2-2 | (0) | (1) | 60 |
| Comparative Example 2 | 2-1, 2-2 | (0) | (2) | 50 |

As is apparent from Table 6, in the printing process employing a development-on-press type printing plate material, the inventive printing method provides a stable and good developability on a press, when printing is continuously carried out while washing the blanket cylinder.

[Effect of the Invention]

The present invention can provide a printing process employing a development-on-press type printing plate material, the printing process giving a stable and good developability on a press and causing no image formation fault on imagewise exposure on a press.

What is claimed is:

1. A printing process employing a printing press comprising a plate cylinder, a blanket cylinder, a dampening roller and an inking roller, and employing a first printing plate material and a second printing plate material each material comprising a hydrophilic support and provided thereon, an image formation layer, the image formation layer at non-image portions being capable of being removed with dampening water or printing ink, the process comprising the steps of:

(a) mounting the first printing plate material having an undeveloped imaae on the plate cylinder;

(b-1) developing the undeveloped image on the first printing plate material on the plate cylinder by supplying dampening water and printing ink to the first printing plate material with the dampening roller and the inking roller thereby to develop the first printing plate for printing, (b-2) carrying out printing by supplying dampening water and printing ink to the developed first printina plate with the dampening roller and the inking roller, and thereafter transferring the printing ink from the first printing plate onto a printing paper sheet through the blanket cylinder, the blanket cylinder contacting the first printing plate material;

(c) then washing the surface of the blanket cylinder with a cleaning solution;

(d) drying the washed surface of the blanket cylinder;

(e) dismounting the first printing plate from the plate cylinder;

(f) mounting the second printing plate material on the plate cylinder; and (g) carrying out printing by supplying dampening water and printing ink to the second printing plate material with the dampening roller and the inking roller, after the step (f).

2. The printing process of claim 1, wherein the step (e) is carried out between the steps (b-2) and (c), or during or after the step (c).

3. The printing process of claim 1, wherein the step (e) is carried out during or after the step (d).

4. The printing process of claim 1, wherein the drying is carried out by wiping off the residual cleaning solution on the blanket cylinder surface with dry cloth.

5. The printing process of claim 1, wherein the drying is carried out by spraying warm air or cold air onto the blanket cylinder surface to eliminate the residual cleaning solution on the blanket cylinder surface.

6. The printing process of claim 1, wherein the drying is carried out by carrying out printing without supplying dampening water or printing ink, whereby the residual cleaning solution on the blanket cylinder surface is transferred onto a printing paper sheet.

7. The printing process of claim 1, wherein the process further comprises the step of forming an image on the printing plate material between the steps (a) and (b-1).

8. The printing process of claim 7, wherein the image formation is carried out by imagewise exposing the printing plate material to infrared laser.

* * * * *